US005979666A

United States Patent [19]

Douglas

[11] Patent Number: 5,979,666

[45] Date of Patent: Nov. 9, 1999

[54] APPARATUS FOR SCREENING PARTICULATE MATERIAL

[76] Inventor: Patrick J. Douglas, Southerlee, College Green, Castletown, Isle of Man IM9 1BE, United Kingdom

[21] Appl. No.: 09/228,157

[22] Filed: Jan. 11, 1999

Related U.S. Application Data

[63] Continuation of application No. 08/640,750, Jun. 28, 1996.

[51] Int. Cl.[6] ..... B07B 1/46

[52] U.S. Cl. ..... 209/241; 209/404; 209/413; 209/420

[56] References Cited

U.S. PATENT DOCUMENTS

| | | | |
|---|---|---|---|
| 4,190,526 | 2/1980 | Bachand | 209/245 |
| 4,303,506 | 12/1981 | Finlay | 209/247 |
| 4,383,651 | 5/1983 | Couperus | 198/313 |
| 4,591,432 | 5/1986 | Hartl | 209/247 |
| 4,879,023 | 11/1989 | Mallaghan | 209/241 |
| 4,981,204 | 1/1991 | Smith | 241/81 |
| 4,983,280 | 1/1991 | Ericksson | 209/241 |
| 5,112,474 | 5/1992 | Douglas | 209/240 |

FOREIGN PATENT DOCUMENTS

| | | | |
|---|---|---|---|
| 378699 | 9/1985 | Australia . | |
| 30798 | 2/1989 | European Pat. Off. . | |
| 2316005 | 3/1977 | France . | |
| 2119290 | 11/1983 | United Kingdom | 209/245 |
| 85/03652 | 8/1985 | WIPO . | |

*Primary Examiner*—Donald P. Walsh
*Assistant Examiner*—Daniel K. Schlak
*Attorney, Agent, or Firm*—Madson & Metcalf

[57] ABSTRACT

An apparatus for screening particulate material having a base frame (11), an elevating conveyor (12), and a conveyor carrying frame (13) adjustably mounted on the base frame (11) and arranged to be capable of moving the conveyor (12) generally lengthwise to adjust the position of an upper end (16) of the end (16) of the conveyor. A sub-frame (18) is pivotally adjustably mounted on the base frame (11) via a pivot (20), and it carries a vibratory screen (17) arranged to receive material falling under gravity from the upper discharge end (16) of the conveyor (12). The sub-frame is adjustable about the pivot in order to adjust the attitude of the screen. A tail conveyor (23) is provided for discharging separate screened portions of the material. A linkage (19, 22) exists between the sub-frame (18) and the carrying frame (13) which includes a direct pivotal connection (20) between the sub-frame and the carrying frame whereby there is simultaneous lengthwise adjustment of the sub-frame. The elevating conveyor (12) and the conveyor carrying frame (13) comprise a main portion **(12*a*, 13*a*) extending from a loading station (14), and an upper end portion (12*b*, 13*b*) which includes the discharge end (16)** of the conveyor. The main and upper end portions are hingedly connected together to allow the apparatus to be converted between an operative mode in which the end portion forms a prolongation of the main portion, and a transport mode in which the end is pivoted downwardly relative to the main portion to reduce the transport height of the discharge end of the conveyor.

16 Claims, 8 Drawing Sheets

APPARATUS FOR SCREENING PARTICULATE MATERIAL

This application is a continuation application of copending application Ser. No. 08/640,750 filed Jun. 28,1996.

This invention relates to a screening apparatus with a tiltable vibratory screen for screening particulate material, such as by separating coarser from finer parts of gravel, coal, crushed rock and similar particulate material.

It is known from EP0301798 to provide a mobile screening apparatus which comprises a base frame; an elevating conveyor arranged to convey material from a loading station at or near to a lower end of the conveyor to a discharge station at an upper end of the conveyor; a conveyor carrying frame adjustably mounted on the base frame and arranged so as to be capable of moving the conveyor generally lengthwise relative to the mounting of the carrying frame on the base frame; drive means coupled with the carrying frame for adjusting the position of the conveyor lengthwise relative to the base frame; guide means for guiding the movement of the carrying frame; a sub-frame pivotally adjustably mounted on the base frame via a pivot and carrying a vibratory screen arranged to receive material falling under gravity from the upper end of the conveyor, said sub-frame being adjustable about said pivot in order to adjust the attitude of the screen to suit any particular operating requirements and in which it is able to receive material falling under gravity from the upper end of the conveyor; discharge means for discharging separate screened portions of the material after treatment by the vibratory screen; and a linkage between the sub-frame and the carrying frame; and characterised in that the linkage comprises a direct pivotal connection between the sub-frame and the carrying frame which forms the sole means of supporting the sub-frame from pivoting under gravity about the pivot, and in that lengthwise adjustment of the carrying frame under the action of the drive means is accompanied by pivotal adjustment of the sub-frame under the sole action of the direct pivotal connection between the sub-frame and the carrying frame such that the vibratory screen takes-up a required adjusted attitude to suit the lengthwise adjusted position of the conveyor.

A screening apparatus of the above type will be referred to hereinafter as "a screening apparatus of the type set forth".

The present invention is primarily, though not exclusively, concerned with improving a screening apparatus of the type set forth and seeks to provide improved folding of the apparatus when it takes up a transport position.

In a screening apparatus of the type set forth, the elevating conveyor is of substantial length, usually extending lengthwise of the apparatus and upwardly away from a hopper feed supply at its lower end. The conveyor elevates the material to be screened to its upper discharge end, from which the material falls under gravity onto an underlying screen deck or "screen box".

The screen is carried by a support frame which is pivotally mounted on a fixed part of the chassis or main frame of the apparatus, and this support frame is also pivotally connected to part of the movable support structure of the elevating conveyor. When it is desired to adjust the angle of inclination of the screen deck (to suit different types/sizes of material to be screened), this takes place automatically upon lengthwise adjustment of the elevator support structure. Adjustment of the screen deck is therefore achieved by a simple operation, and this also has the advantage that the upper discharge end or the elevator remains positioned substantially above the upper and normal receiving end of the screen deck, for all positions of adjustment of inclination of the screen deck. This contributes significantly to screening efficiency, as evidently it would be undesirable for the material to be screened to be deposited on the screen deck a substantial distance downwardly from the upper end of the screen deck.

However, the overall height of the apparatus (in both its operating and its transport mode) is determined to some extent by the length of the screen deck, and if it should be desired to increase the length of the screen deck substantially for certain customers, this may cause the overall height of the apparatus, in its transport mode, to be higher than may be preferred.

It should be borne in mind that mobile screening apparatus, despite being large pieces of plant used in quarries, must be capable of being transported from one site to another, and therefore it is important that the overall height of the apparatus, in the transport mode, should be low enough to pass under normal motorway and other highway bridges.

According to the present invention there is provided a screening apparatus for screening particulate material and comprising:

a base frame;

an elevating conveyor arranged to convey material from a loading station at or near to a lower end of the conveyor to a discharge station at an upper discharge end of the conveyor;

a conveyor carrying frame adjustably mounted on the base frame and arranged so as to be capable of moving the conveyor generally lengthwise in order to adjust the position of the upper end of the conveyor;

a sub-frame pivotally adjustably mounted on the base frame via a pivot and carrying a vibratory screen arranged to receive material falling under gravity from the upper discharge end of the conveyor, said sub-frame being adjustable about said pivot in order to adjust the attitude of the screen to suit any particular operating requirements and in which it is able to receive material falling under gravity from the upper discharge end of the conveyor;

discharge means for discharging separate screened portions of the material after treatment by the vibratory screen; and a linkage between the sub-frame and the carrying frame which includes a direct pivotal connection between the sub-frame and the carrying frame whereby pivotal adjustment of the sub-frame, to adjust the attitude of the screen, is accompanied by general lengthwise adjustment of the carrying frame such that the lengthwise adjusted position of the discharge end of the conveyor corresponds with the adjusted attitude of the screen.

in which:

1. the elevating conveyor and the conveyor carrying frame comprise a main portion extending from the loading station, and an upper end portion which includes the discharge end of the conveyor, said portions being hingedly connected together to allow the apparatus to be converted between an operative mode in which the end portion forms a prolongation of the main portion, and a transport mode in which the end portion is pivoted downwardly relative to the main portion thereby to reduce the transport height of the discharge end of the conveyor;
2. the sub-frame is pivotally connected to said end portion so as to permit adjustment of the inclination of the screen simultaneously with lengthwise adjustment of the carrying frame when the apparatus is in its operative mode; and, 3. when the apparatus is converted to its transport mode, downward adjustment of said end portion is accompanied by downward adjustment of the screen.

Therefore, when the apparatus is converted to its operative mode, the main portion and the end portion (of the elevating conveyor and the conveyor carrying frame) form effectively a unitary structure which can function to elevate material to be screened, and which structure can be adjusted lengthwise simultaneously with adjustment of the angle of inclination of the screen, and with the upper discharge end of the conveyor remaining located at a desired position above a material receiving end of the screen for all adjusted operative positions of the conveyor and screen. However, upon conversion of the apparatus to the transport mode, the end portion is allowed to pivot downwardly in order to reduce the overall height of the apparatus, and this downward adjustment of the end portion is accompanied by downward pivoting of the screen.

Any suitable means may be provided to permit the apparatus to be converted between its operative mode and its transport mode. By way of example only, this conversion means may comprise a telescopically adjustable strut (preferably ram-operated) extending between a suitable mounting point on the base frame and the sub-frame which carries the screen.

Preferably, the conversion means also includes a support upstanding from the base frame and arranged to engage and then bear the load of the main portion when the apparatus is undergoing conversion to the transport mode, and which therefore readily allows the end portion to pivot downwardly relative to the main portion (under continued operation of the ram driving the adjustment of the strut) in order to reduce the overall height of the apparatus.

The apparatus is preferably a mobile apparatus having a wheel set to support at least part of the dead load of the apparatus, and the loading end of the apparatus may be designed so as to be capable of being mounted on a "fifth wheel" or other type of coupling of a tractor vehicle.

A foldable "tail conveyor" may be arranged below the screen, and which can be pivoted between an operative position in which screened material passing through the screen can be discharged from the apparatus, and to a transport position in which relative folding of separate components of the tail conveyor take place whereby the overall length of the apparatus is reduced. This folding between the transport and operative positions is permitted by reason of the geometry of the tail conveyor sections and their relationship to the mounting of the screen, sub-frame, elevating conveyor and conveyor carrying frame.

Preferred embodiments of the invention will now be described in detail, by way of example only, with reference to the accompanying drawings, in which.

Figure 7:
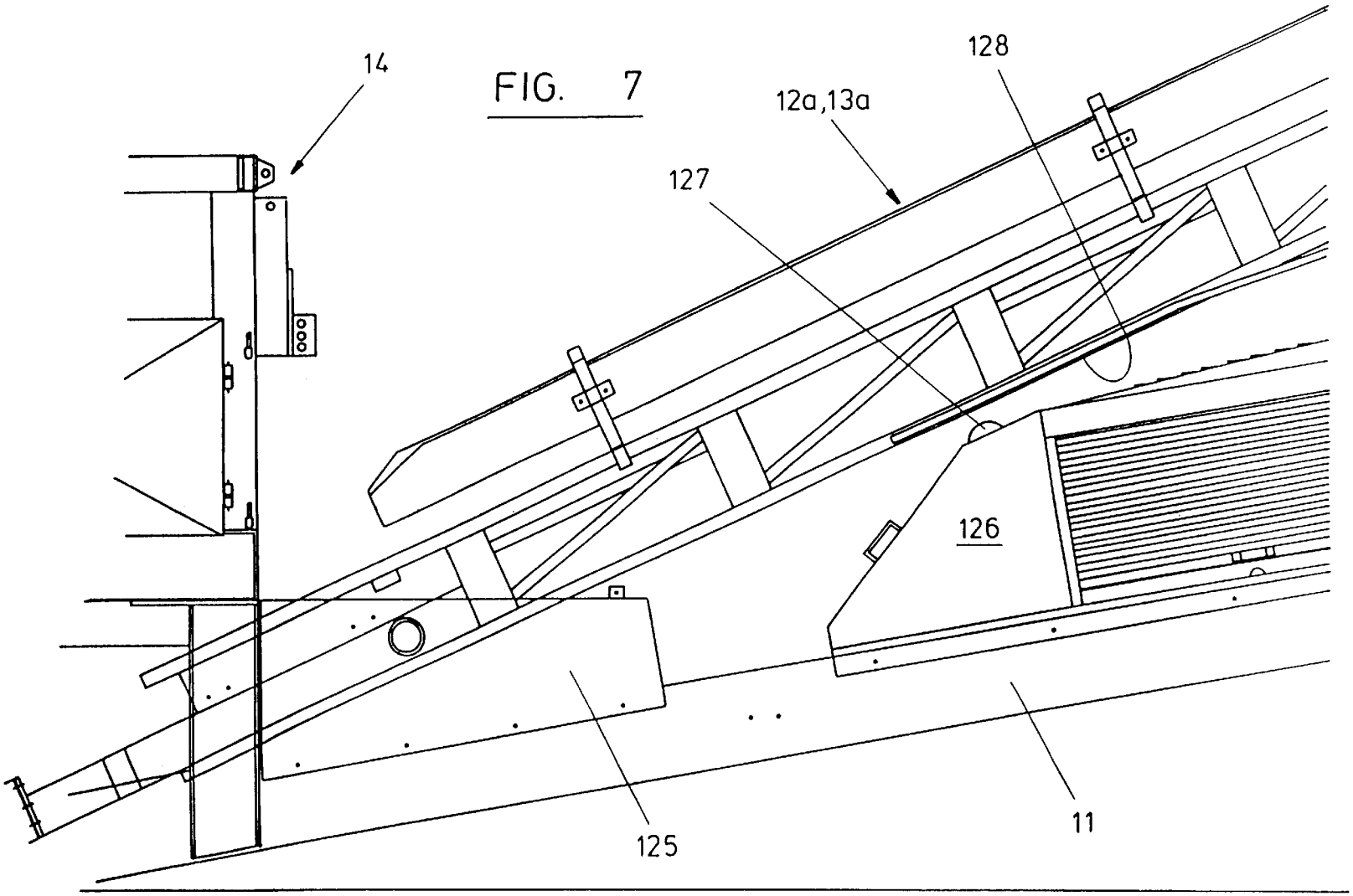
Figure 8:
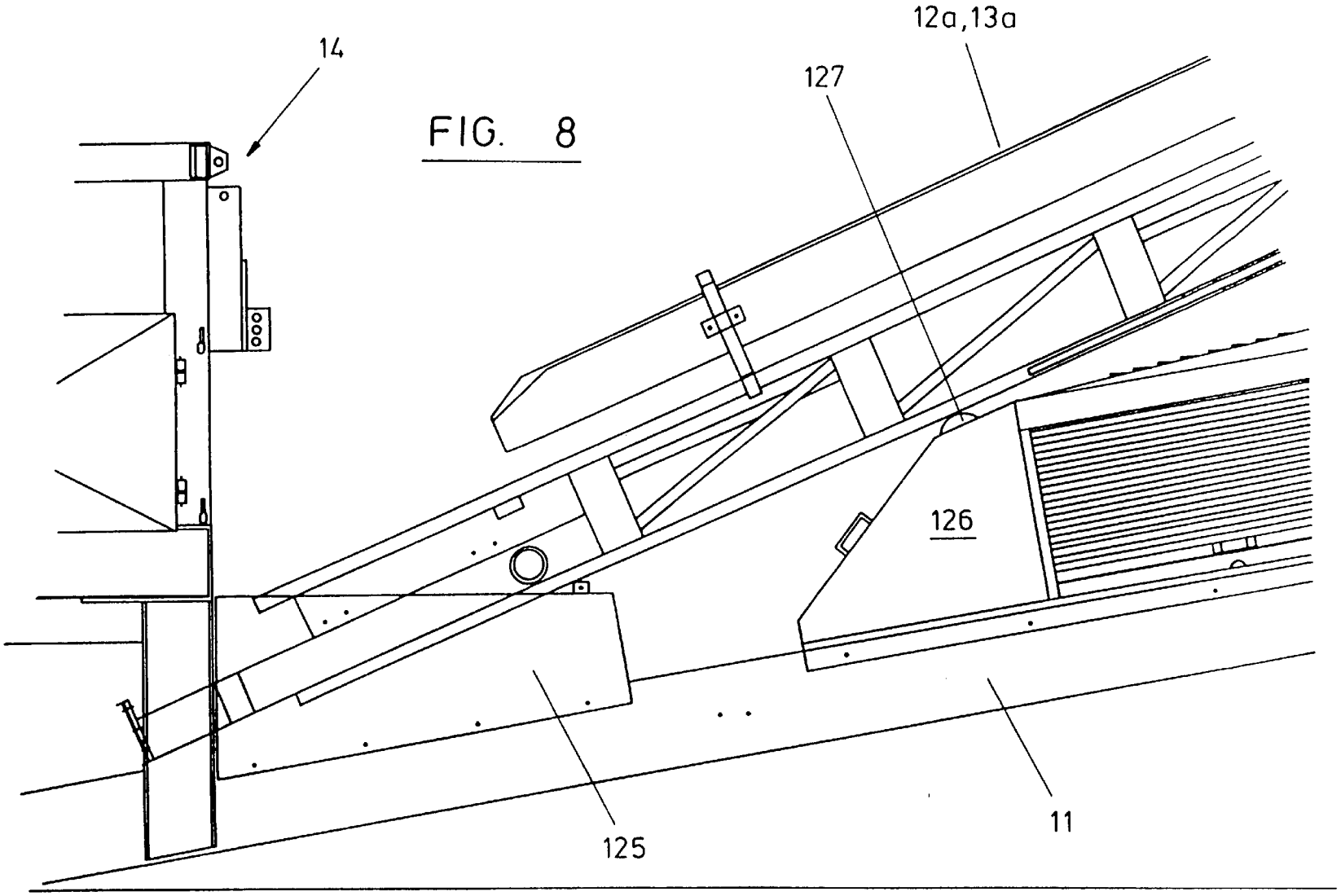

FIG. 7 is a side view, to an enlarged scale, showing the mounting of a lower end of the elevating conveyor and its supporting carrying frame, at a loading station of the apparatus, with the conveyor components shown in an operative mode; and, FIG. 8 is a view, similar to FIG. 7, but showing the elevator components in an adjusted position, following conversion of the apparatus to the transport mode.

Referring first to FIGS. 1 to 4 of the drawings, a screening apparatus according to the invention is designated generally by reference 10 and comprises a wheel-supported base frame 11, an elevating conveyor 12 comprising an endless belt 28 which is arranged to convey material from a loading station at or near to a lower end of the conveyor to a discharge station at an upper end of the conveyor, and a conveyor carrying frame 13 adjustably mounted on the base frame 11 and arranged so as to be capable of moving the conveyor 12 generally lengthwise relative to the mounting of the carrying frame 13 on the base frame 11. The belt 28 is taken around upper and lower return end drums to follow its required endless path, of which only upper drum 29 is clearly visible in the drawings.

The loading station, in the illustrated embodiment, comprises a hopper 14, into which material to be screened can be loaded, and the base 15 of the hopper 14 is designed so as to be capable of being mounted on a "fifth wheel coupling" of a tractor vehicle when the apparatus has been converted to the transport mode and is to be transported from one site to another.

The upper discharge end 16 of conveyor 12 is located above an upper material receiving end of an underlying screen designated generally by reference 17. Screen 17 may comprise a "screen box" which is a multi-deck screen.

Drive means (not shown in detail) may be coupled with the conveyor carrying frame 13 to adjust the position of the conveyor 12 lengthwise relative to the base frame 11, and guide means (not shown in detail) is provided at the lower end of the conveyor frame 13 to guide the movement of the frame 13.

A sub-frame 18 supports the screen 17, and comprises A-frame support structures 19 arranged one at each side of the screen 17, and each being pivotally mounted on the base frame or chassis of the apparatus via a horizontal pivot 20 carried by an upstanding support structure 21 mounted at the rear end of the base frame 11.

Each A-frame structure 19 also has a pivotal connection 22 with the conveyor carrying frame 13, and each A-frame structure 19 can be pivotally adjusted about pivot 20 in order to vary the attitude or inclination of the screen 17 to suit any particular operating requirements, and in which it is able to receive material falling under gravity from the upper discharge end 16 of the conveyor 12.

Discharge means (not shown in detail) are provided to discharge separate screened portions of the material after treatment by the vibratory screen 17.

By reason of the pivotal connection 22 between the sub-frame support structure 18 of the screen 17 with the lengthwise adjustable conveyor carrying frame 13, it is possible to carry out lengthwise adjustment of the carrying frame 13 accompanied by simultaneous adjustment of the angle of inclination of screen 17 so that the screen 17 takes-up a required adjusted attitude to suit the lengthwise adjusted position of the conveyor 12, whereby the discharge end 16 can remain located substantially above a normal material receiving upper end of the screen 17 for all required positions of adjustment of the inclination of the screen.

Figure 1:
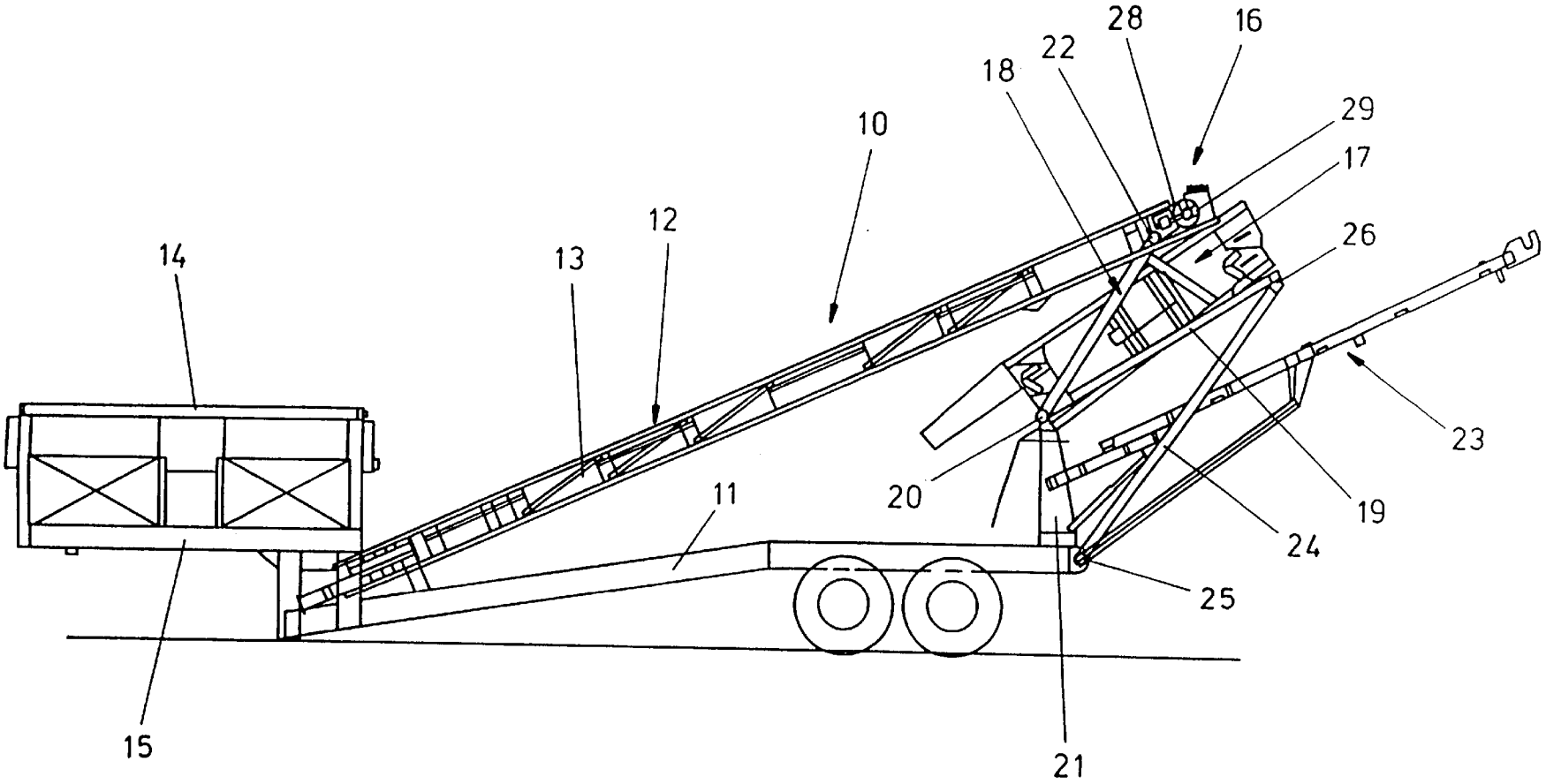
FIG. 1 is a side view of the screening apparatus with the component parts shown in the positions taken-up for the operative mode of the apparatus.

A "tail conveyor" structure designated generally by reference 23 is mounted at the rear end of base frame 11, and is shown in FIG. 1 in the operative position in which material which passes downwardly through the screen 17 is received by the tail conveyor 23, and can then be rearwardly and upwardly discharged from the apparatus.

Figure 2:
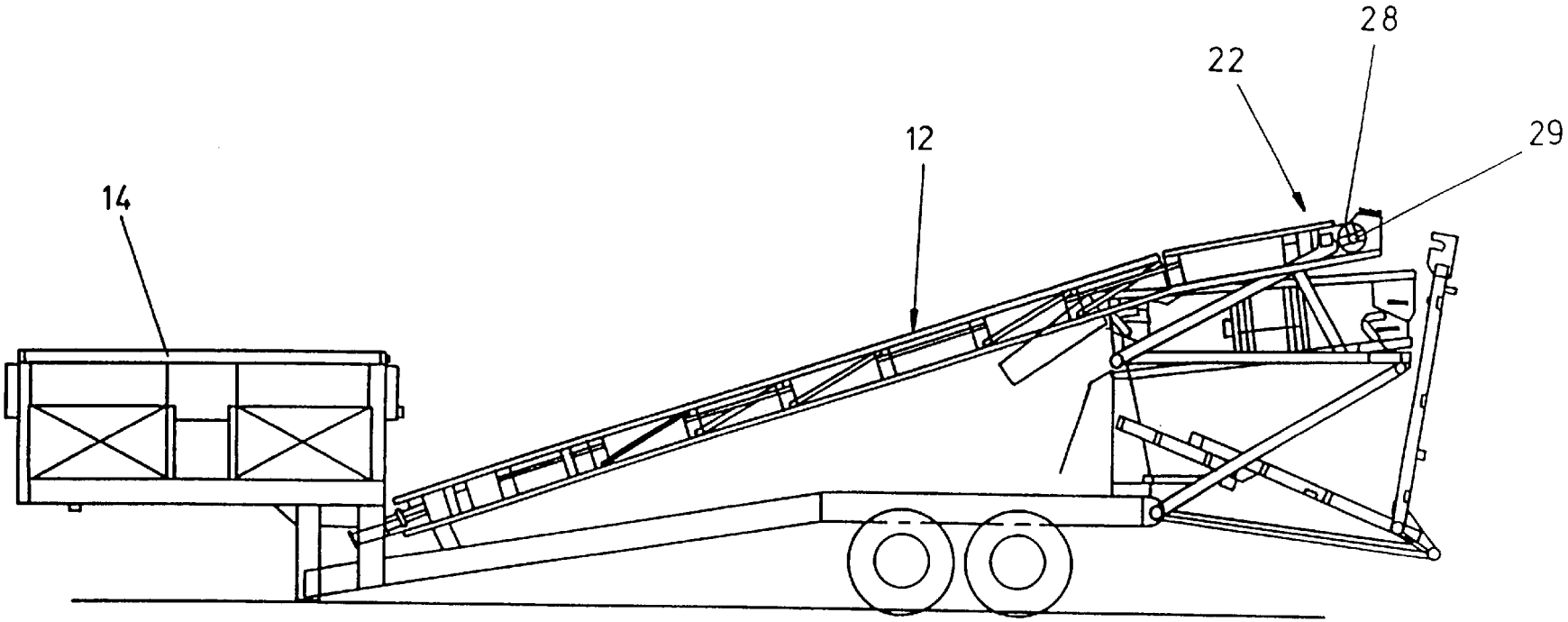
FIG. 2 is a view, similar to FIG. 1, but showing the apparatus converted to its transport mode.
Figure 3:
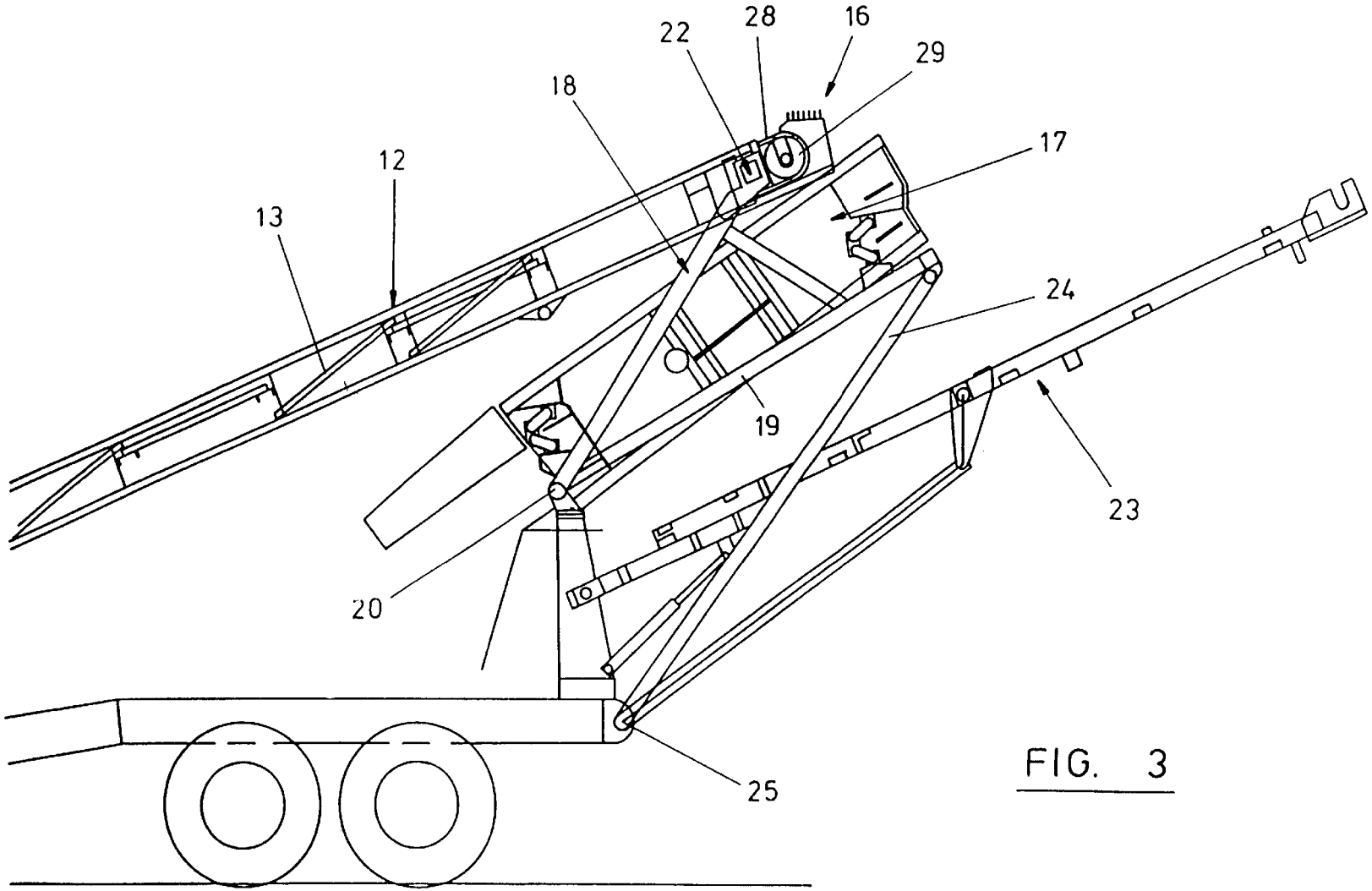
FIG. 3 is a detail view of the upper discharge end of the elevating conveyor and screen of the apparatus, occupying operative positions.
Figure 4:
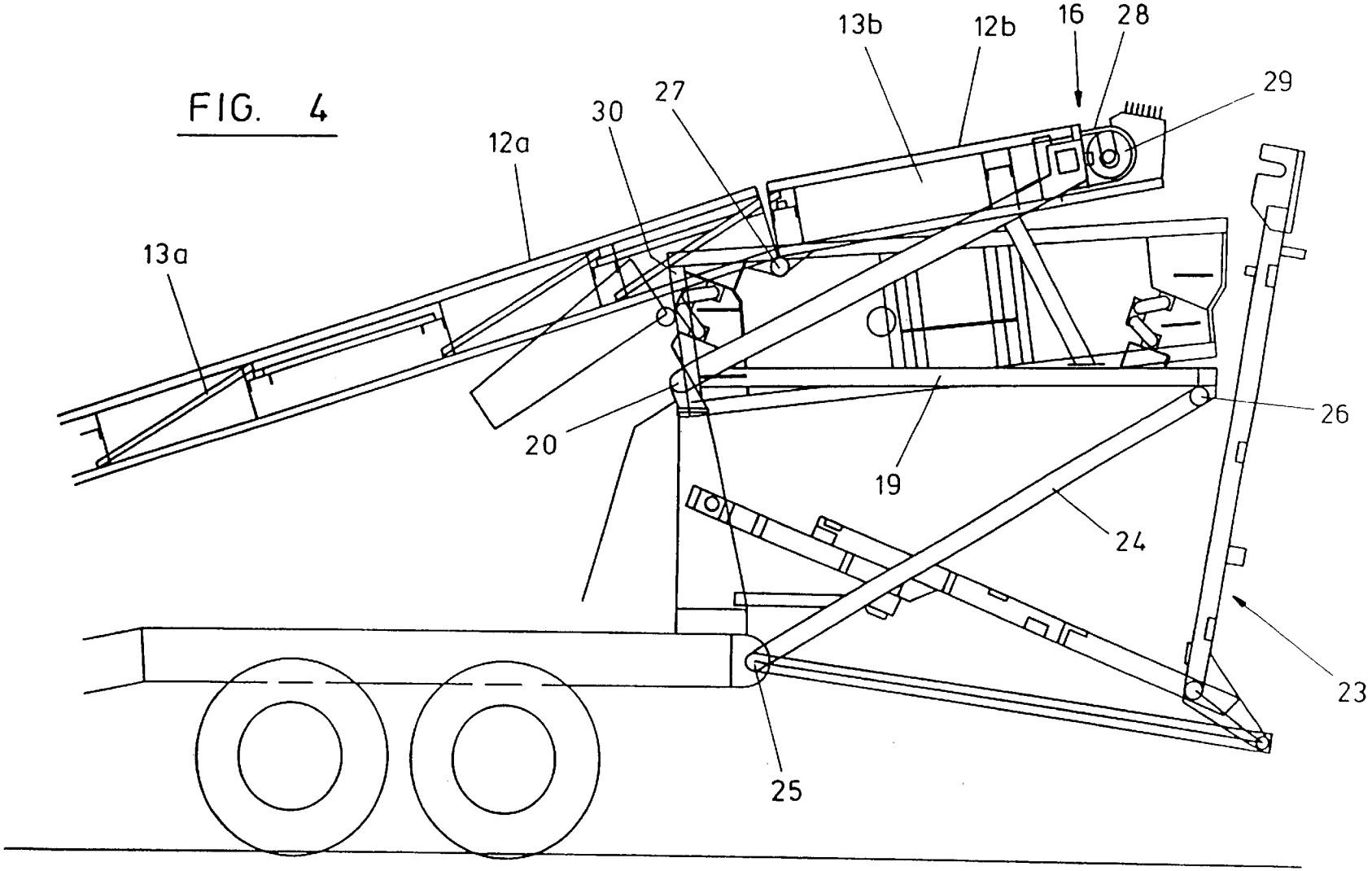
FIG. 4 is a view, similar to FIG. 3, but showing the same components converted to the transport mode of the apparatus.

FIG. 1 of the drawings shows the operating components of the apparatus in their operative positions when the apparatus is converted to its operative mode, and FIG. 3 shows, to an enlarged scale, the relationship between the upper discharge end 16 of the conveyor 12, sub-frame 18, screen box 17, and tail conveyor 23. FIGS. 2 and 4 correspond with FIGS. 1 and 3 respectively, but show the positions taken-up by the operative components when adjusted to the transport mode of the apparatus.

Referring now to FIGS. 3 and 4, it should be noted that the elevating conveyor 12 and the elevator carrying frame 13 are each divided into two portions, namely a main portion which extends away from the loading station, (designated by references 12*a* and 13*a* respectively in these figures), and an upper end portion, designated by references 12*b* and 13*b* and which include the upper discharge end 16 of the conveyor 12.

The main portion (12*a*, 13*a*) and the upper end portion (12*b*, 13*b*) are hingedly connected together to allow the apparatus to be converted between an operative mode, as shown in FIG. 3, in which the end portion forms a prolongation of the main portion, and a transport mode (shown in FIG. 4) in which the height of the discharge end 16 is reduced.

Furthermore, the sub-frame 18 is effective, when the apparatus is in the operative mode, to permit adjustment of the inclination of the screen 17 in response to lengthwise adjustment of the carrying frame 13, when the main portion and the end portion are held together in the operative position shown in FIG. 3, and effectively form a unitary structure which can be lengthwise adjusted.

However, when the apparatus is converted to its transport mode, as shown in FIG. 4, the sub-frame 18 enables downward adjustment of the end portion to be accompanied by downward adjustment of the screen 17.

Preferred means to convert the elevating conveyor 12 and the screen box 17 between the operative mode and the transport mode will now be described. This means also functions to carry out adjustment of the screen box inclination, and comprises a ram or cylinder operated telescopic support 24 which extends between a pivotal connection 25 at its lower end with a fixed part of the chassis and which is pivotally connected at its upper end 26 to any convenient part of the screen 17 in order to support the latter and thereby maintain the main portion and the end portion in the operative position. As shown in the drawings, upper end 26 is pivotally connected to part of the A-frame 19.

The tail conveyor 23 is shown in FIGS. 1 and 3 in an operative position to discharge material which passes through the screen 17, whereas it can be folded to the transport position shown in FIGS. 2 and 4. The geometry of the tail conveyor 23, screen 17, sub-frame 18, and their relationship to each other allows the various components of the apparatus to be adjusted between operative modes and transport modes without interfering with each other.

As can be seen particularly clearly from FIG. 4, the main portion. (12*a*, 13*a*) and the end portion (12*b*, 13*b*) are hingedly connected together via a horizontal pivot 27, and adjustment of the length of telescopic support 24 allows the screen box 17 to pivot about pivot 20, and the end portion (12*b*, 13*b*) to pivot about horizontal pivot 27 i.e. the main portion and the end portion no longer form a unitary structure which can be lengthwise adjusted as a unit. The lowering of the screen box 17 is accompanied by downward adjustment of the overall conveyor 12 and carrying frame 13, which reduces the overall height of the apparatus, and as this proceeds, the main portion (12*a*, 13*a*) comes into abutment with an upward supporting structure (not shown in FIGS. 1 to 4, but see FIGS. 7 and 8 and as described later) and which then allows the end portion (12*b*, 13*b*) to "break-open" the hinged connection whereby end portion (12*b*, 13*b*) then opens-up the hinge as shown in FIG. 4.

Therefore, despite the fact that the screen 17 which is illustrated is of greater length than normal, to meet certain customer requirements, the apparatus can be readily converted to a transport mode in which the overall height of the apparatus is reduced to preferred levels suitable for transport of the apparatus as a towed vehicle along the public highway, and without risk of being obstructed by normal highway bridges.

Telescopic support 24 may comprise a hydraulically or pneumatically adjustable ram type structure, or may comprise a manually adjustable support. The effective length of support 24 will be varied during each adjustment of the angle of inclination of the screen 17 when the apparatus is in the operative mode shown in FIGS. 1 and 3, and also will have its effective length adjusted to follow, or to permit adjustment of the screen 17, sub-frame 18 and end portion 12*b*, 13*b* to the transport mode.

Thus, support 24 may be used both to convert the screening plant between operative and transport modes, but also to adjust the inclination of the screen box to different required positions in the operative mode (which will be accompanied by suitable adjusting movement of the upper discharge end of the elevator).

Referring now to FIGS. 5 to 8, this shows some modifications and improvements to the constructional features shown in FIGS. 1 to 4, and corresponding parts are given the same reference numerals, and will not be described in detail again.

In the embodiment of FIGS. 1 to 4, the telescopically adjustable support 24 may comprise the sole means to adjust the inclination of the screen box 17, accompanied by generally longitudinal adjustment of the elevating conveyor 12 and its supporting frame 13 to maintain the upper discharge end of the elevator near the upper end of the screen box for all of its inclinations, when in the operative mode. The support 24 also serves to convert the apparatus to the transport mode, by pulling the elevator frame and simultaneously lowering its upper end until such time as the main portion 12*a*, 13*a* of the elevator and the carrying frame have their further downward motion arrested by the abutment, as described above, which then allows the hinge at pivot 27 to "break open". Alternatively, or additionally, a separate drive means may be provided (not shown) at the lower end of the elevator i.e. at the loading station, to effect necessary generally linear movement of the elevator and the carrying frame.

Figure 5:
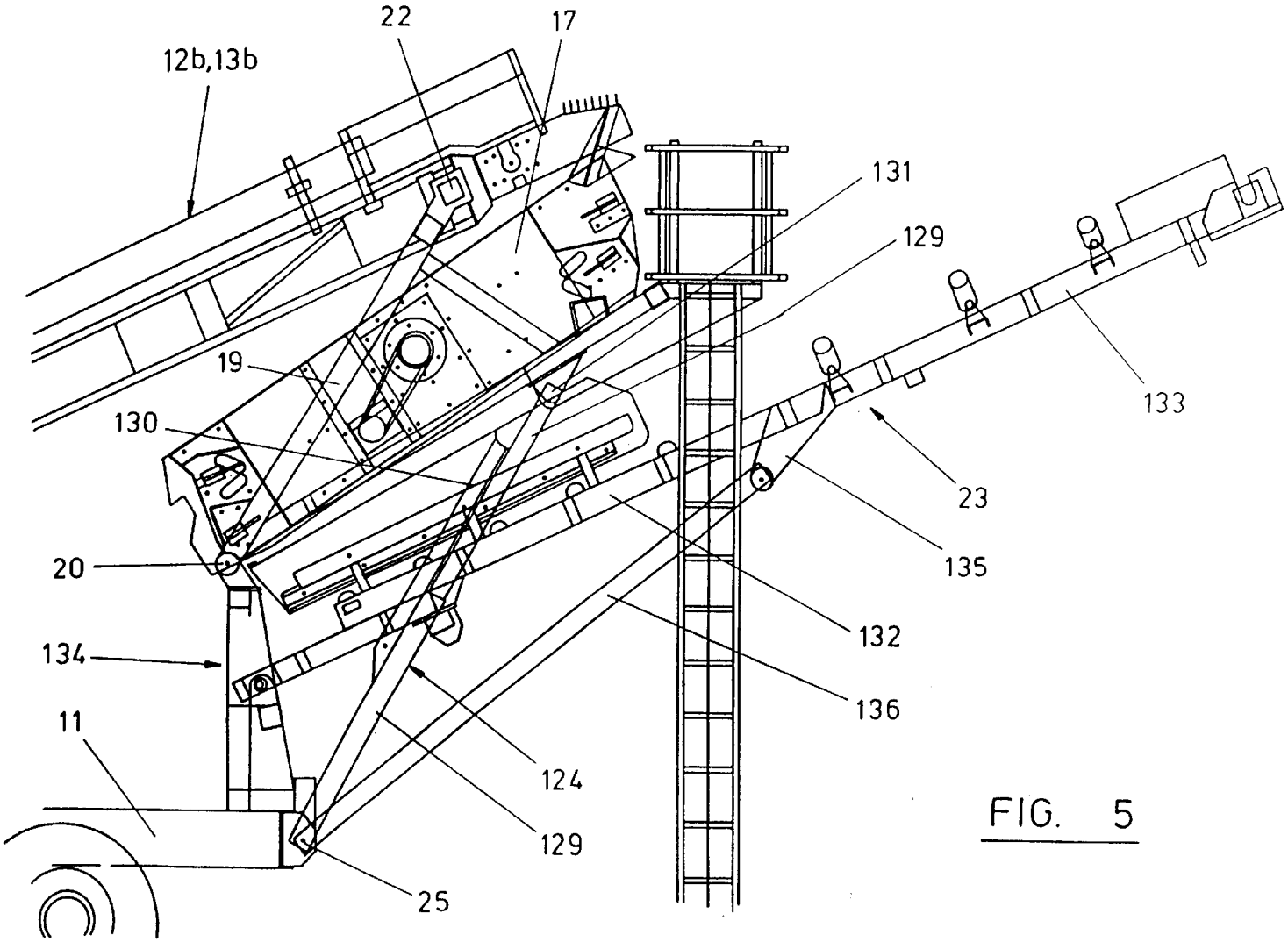
FIG. 5 is a side view similar to FIG. 3, illustrating in more detail an adjustable support leg arrangement for adjusting a screen box and a co-operating elevator of the apparatus between different working positions in an operative mode of the apparatus, and also for converting the apparatus to a transport mode.
Figure 6:
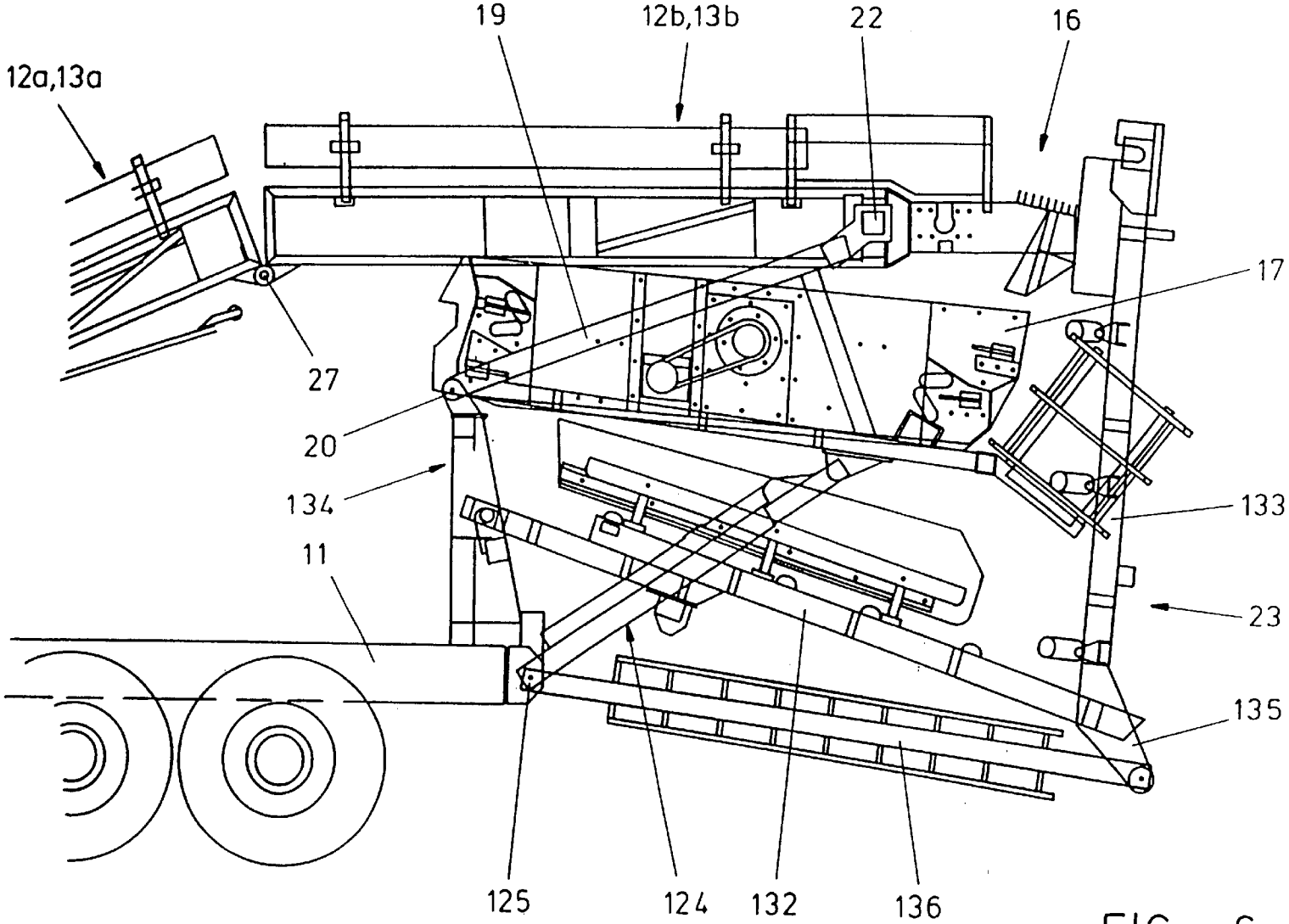
FIG. 6 is a view, similar to FIG. 4, illustrating the arrangement of FIG. 4 adjusted from an operative mode to a transport mode.

The modified embodiment shown in FIGS. 5 to 8 relies solely upon the telescopic support, and which is shown in more detail and designated generally by reference 124. As can be seen in FIGS. 5 and 6, telescopic support 124 is in two parts, comprising a telescopic arrangement of tubes 129 and a hydraulically operated cylinder 130 operative to extend or contract the overall length of the telescopic tube assembly 129. The lower end of the support leg arrangement 124 is pivoted on common pivot 25, which also mounts the folding tail conveyor 23, and the upper end 131 of leg arrangement 124 is pivoted to one arm of the A-frame support structure 19 which carries the screen box 17, and which is pivoted at 22 to the upper and of the separate end portion 13*b* of the carrying frame 13 for the elevator 12.

FIG. 5 shows the elevator and screen box in one adjusted position which it can adopt, in an operative mode, whereas FIG. 6 shows the components in the positions taken-up after conversion to the transport mode.

Although not shown in detail, resilient connections are provided between separate panels which make-up the assembly of the endless conveyor belt forming elevator 12, to permit the main elevator portion 12*a* and end portion 12*b* to partly hinge open as shown in FIG. 6 to take-up the transport mode. A spring assembly may also be provided, which works in conjunction with the conveyor pivot 27, and to allow relative pivotal movement to take place during adjustment between the transport mode and the operative mode.

In connection with the embodiment of FIGS. 1 to 4, there has been described above (but not shown in the drawings), the provision of a fixed abutment on the supporting structure which can be engaged, (during lengthwise movement of the elevator and the carrying frame following downward pivotal adjustment of screen box 17, and which causes a small amount of downward somewhat pivotal movement of the elevator and the carrying frame with respect to the lower end), thereby arresting further movement downwardly of the main portion 12*a*, 13*a*, and then allowing the hinge formed by pivot 27 to "break open". An example of an abutment arrangement which may be used is shown in FIGS. 7 and 8, and which will now be described.

The lower end of the sloping part of the base frame 11, adjacent to the loading hopper 14, is provided with guide means 125, which guides the generally lengthwise movement of the elevator 12 and carrying frame 13 which, as described above, is generally lengthwise movement, but also involves a small mount of upward and downward generally pivotal movement about the lower end of the elevator/carrying frame, in that every time lengthwise adjustment of the elevator takes place, this is accompanied by pivotal adjustment of the screen box 17 about pivot 20, and via the pivot connection 22 between the A-frame support 19, a small amount of upward or downward pivoting of the elevator/carrying frame also takes place. The guide means 125 is capable of accommodating this combined lengthwise/pivotal movement.

It should be understood, however, that this combined lengthwise and pivotal adjustment takes place, in the operative mode of the apparatus, when the two portions of the elevator (12*a*, 12*b*) and the two portions of the carrying frame (13*a*, 13*b*) effectively form a unitary structure. However, when it is desired to convert the apparatus to the transport mode, the telescopic support leg 24 (preferably arranged one at each side and each connected to a respective sub-frame 19), will be effectively retracted which initially causes an upward pulling movement along the length of the elevator/carrying frame, as the screen box 17 pivots clockwise about pivots 20, and this causes a small degree of clockwise pivoting of the elevator/carrying frame assembly about the lower end, so that a lower part 128 (see FIG. 7) of the carrying frame 13 progressively approaches a fixed abutment 127. Abutment 127 is shown mounted on a housing structure 126 (housing any required operating components of the apparatus), and FIG. 7 shows the carrying frame 13 occupying a position in which the apparatus is still capable of working in any desired one of its operating modes, whereas FIG. 8 shows downward adjustment until such time as frame part 128 engages abutment 127. The abutment 127 therefore then bears the load of the main portion 12*a* of the elevator and main portion 13*a* of the carrying frame, whereby further adjustment of the support leg assemblies 124 in a retracting sense then causes the "hinge" to break open, and for the end portions 12*b*, 13*b* of the elevator and carrying frame to pivot clockwise, thereby lowering the overall height of the apparatus by lowering the discharge end of the elevator, and which is also accompanied by simultaneous downward pivoting of the screen box 17 also to take-up a transport position.

The tail conveyor 23 is mounted on the frame of the apparatus so that it can readily be adjusted between the operative position, shown in FIG. 5, in which the two conveyor portions 132, 133 form a unitary straight line structure, and the transport position in which conveyor portion 133 is folded to an upright position, thereby to reduce the overall length of the apparatus. Conveyor portions 132 and 133 are pivotally connected together, and conveyor portion 132 is pivotally mounted on a support structure 134 upstanding from the base frame 11, whereas conveyor portion 133 has a lever arm connection 135 by which it is pivotally connected to a support strut 136 which is pivoted to the base frame 11 on the same pivot 25 on which telescopic leg 124 is pivotally mounted. Strut 136 supports the tail conveyor 23, when it is in the operative position shown in FIG. 5, but assists in the manipulation of the conveyor portions 132 and 133, via lever arm 135 and the general geometry of the four bar type linkage incorporated in the tail conveyor assembly, whereby to incline conveyor portion 132 downwardly, as shown in FIG. 6, and to pivot conveyor portion 133 upwardly to the transport position.

I claim:

1. A screening apparatus for screening particulate material and comprising:

a base frame;

a loading station;

a discharge station;

an elevating conveyor having a lower end arranged to receive material at the loading station and an upper discharge end via which the material is conveyed to the discharge station;

a conveyor carrying frame adjustably mounted on the base frame and arranged to support said conveyor;

a sub-frame adjustably mounted on the base frame;

a vibratory screen carried by said sub-frame and arranged to receive material falling under gravity from the upper end of the conveyor, said sub-frame being adjustable in order to vary the attitude of the screen to suit any particular operating requirements;

discharge means for discharging separate screened portions of the material after treatment by the vibratory screen; and a linkage between the sub-frame and the carrying frame which is operative to cause joint adjustment of the carrying frame and the sub-frame so that the upper end of the conveyor takes-up any required adjusted position corresponding to a change in attitude of the vibratory screen;

in which:

(a) the elevating conveyor and the conveyor carrying frame together comprise a main portion extending from the loading station, and an upper end portion which includes the discharge end of the conveyor, said main portion and said upper end portion being hingedly connected together to allow the apparatus to be converted between an operative mode in which the end portion forms a prolongation of the main portion, and a transport mode in which the end portion is pivoted downwardly relative to the main portion thereby to reduce the transport height of the discharge end of the conveyor;

(b) the sub-frame is connected to said end portion so as to permit adjustment of the inclination of the vibratory screen simultaneously with adjustment of the carrying frame when the apparatus is in its operative mode;

(c) downward adjustment of said end portion during conversion to the transport mode is accompanied by downward adjustment of the vibratory screen; and (d) an adjustable device interconnecting said base frame and said subframe, said adjustable device being operative to adjust the attitude of the vibratory screen and to make corresponding adjustment of the discharge end of the conveyor, so as to take-up any required working position in the operative mode of the apparatus, and said device also being operative to convert the apparatus between the operative mode and the transport mode.

2. Apparatus according to claim 1, including a substantially horizontally extending pivot which hingedly connects together said main portion and said end portion of the conveyor and the carrying frame.

3. Apparatus according to claim 1, and including a pivot which adjustably mounts said sub-frame on the base frame, said sub-frame comprising a pair of A-frames mounted one on each side of said vibratory screen and each pivotally connected to said sub-frame pivot via the apex of each A-frame.

4. Apparatus according to claim 3, wherein the adjustable device comprises a telescopically adjustable support leg which is pivotally connected at one end to the base frame, and at its other end to one of the A-frames, said support leg being operative to adjust the attitude of the vibratory screen and to make corresponding adjustment of the discharge end of the conveyor, so as to take-up any required working position in the operative mode of the apparatus, and said support leg also being operative to convert the apparatus between the operative mode and the transport mode.

5. Apparatus according to claim 1, in which said adjustable device comprises a telescopically adjustable support leg.

6. Apparatus according to claim 1, including guide means arranged to control generally lengthwise adjustment of said conveyor and said carrying frame, and also permitting generally pivotal adjustment of the main portion and the end portion of the conveyor and also of the carrying frame, as a consequence of adjustment of the attitude of the vibratory screen to take-up a different working position in the operative mode of the apparatus.

7. Apparatus according to claim 6, including an abutment arranged in the path of pivotal movement of said main portion of the conveyor and the carrying frame, so as to define a limit to this pivotal movement whereby further lengthwise adjustment will result in said end portion thereafter pivoting downwardly relative to said main portion in order to reduce the transport height of the discharge end of the conveyor.

8. Apparatus according to claim 1, including a tail conveyor mounted on the base frame, a parallelogram linkage which connects the tail conveyor to the base frame and which is operative to allow two separate portions of the tail conveyor to be adjusted between a straight line operative position extending upwardly and outwardly away from a lower receiving end below the vibratory screen, and a transport position in which one of said portions of the tail conveyor can be folded upwardly thereby to reduce the overall length of the apparatus.

9. A screening apparatus for screening particulate material and comprising:

a base frame;

a loading station;

a discharge station;

an elevating conveyor having a lower end arranged to receive material at the loading station and an upper discharge end via which the material is conveyed to the discharge station;

a conveyor carrying frame mounted on the base frame and arranged to support said conveyor;

a sub-frame adjustably mounted on the base frame;

a vibratory screen carried by said sub-frame and arranged to receive material falling under gravity from the upper end of the conveyor, said sub-frame being adjustable in order to vary the attitude of the screen to suit any particular operating requirements;

discharge means for discharging separate screened portions of the material after treatment by the vibratory screen; and means connecting the sub-frame to the carrying frame which permits joint adjustment of the carrying frame and the sub-frame so that the upper end of the conveyor takes-up a required adjusted position corresponding to a change in attitude of the vibratory screen;

in which:

(a) the elevating conveyor and the conveyor carrying frame together comprise a main portion extending from the loading station, and an upper end portion which includes the discharge end of the conveyor, said main portion and said upper end portion being hingedly connected together to allow the apparatus to be converted between an operative mode in which the end portion forms a prolongation of the main portion, and a transport mode in which the end portion is pivoted downwardly relative to the main portion thereby to reduce the transport height of the discharge end of the conveyor;

b), the sub-frame is connected to said end portion so as to permit adjustment of the inclination of the vibratory screen simultaneously with adjustment of said discharge end of the conveyor when the apparatus is in its operative mode;

(c) downward adjustment of said end portion during conversion to the transport mode is accompanied by downward adjustment of the vibratory screen; and (d) an adjustable device interconnecting said base frame and said subframe, said adjustable device being operative to adjust the attitude of the vibratory screen and to make corresponding adjustment of the discharge end of the conveyor, so as to take-up a required working position in the operative mode of the apparatus, and said device also being operative to convert the apparatus between the operative mode and the transport mode.

10. Apparatus according to claim 9, including a substantially horizontally extending pivot which hingedly connects together said main portion and said end portion of the conveyor and the carrying frame.

11. Apparatus according to claim 9, and including a pivot which adjustably mounts said sub-frame on the base frame, said sub-frame comprising a pair of A-frames mounted one on each side of said vibratory screen and each pivotally connected to said sub-frame pivot via the apex of each A-frame.

12. Apparatus according to claim 11, wherein the adjustable device comprises a telescopically adjustable support leg which is pivotally connected at one end to the base frame, and at its other end to one of the A-frames, said support leg being operative to adjust the attitude of the vibratory screen and to make corresponding adjustment of the discharge end of the conveyor, so as to take-up any required working position in the operative mode of the apparatus, and said support leg also being operative to convert the apparatus between the operative mode and the transport mode.

13. Apparatus according to claim 9, in which said adjustable device comprises a telescopically adjustable support leg.

14. Apparatus according to claim 9, including guide means arranged to control generally lengthwise adjustment of said conveyor and said carrying frame, and also permitting generally pivotal adjustment of the main portion and the end portion of the conveyor and also of the carrying frame, as a consequence of adjustment of the attitude of the vibratory screen to take-up a different working position in the operative mode of the apparatus.

15. Apparatus according to claim 14, including an abutment arranged in the path of pivotal movement of said main portion of the conveyor and the carrying frame, so as to define a limit to this pivotal movement whereby further lengthwise adjustment will result in said end portion thereafter pivoting downwardly relative to said main portion in order to reduce the transport height of the discharge end of the conveyor.

16. Apparatus according to claim 9, including a tail conveyor mounted on the base frame, a parallelogram linkage which connects the tail conveyor to the base frame and which is operative to allow two separate portions of the tail conveyor to be adjusted between a straight line operative position extending upwardly and outwardly away from a lower receiving end below the vibratory screen, and a transport position in which one of said portions of the tail conveyor can be folded upwardly thereby to reduce the overall length of the apparatus.

* * * * *

UNITED STATES PATENT AND TRADEMARK OFFICE

CERTIFICATE OF CORRECTION

PATENT NO : 5,979,666
DATED : November 9, 1999
INVENTOR(S) : Patrick J. Douglas

It is certified that error appears in the above-identified patent and that said Letters Patent are hereby corrected as shown below:

On the title page, Item [56]

In Referenced Cited Foreign Patent Documents, please change "30798" to -301,798-

In column 7, line 9, please change "and" to --end--.

Signed and Sealed this

Fifth Day of December, 2000

*Attest:*

*Attesting Officer*

Q. TODD DICKINSON

*Director of Patents and Trademarks*